US006545655B1

(12) United States Patent
Fujikawa

(10) Patent No.: US 6,545,655 B1
(45) Date of Patent: Apr. 8, 2003

(54) LCD DEVICE AND DRIVING METHOD THEREOF

(75) Inventor: Masaru Fujikawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/522,067

(22) Filed: Mar. 9, 2000

(30) Foreign Application Priority Data

Mar. 10, 1999 (JP) ..... 11-062807

(51) Int. Cl.[7] ..... G09G 3/36
(52) U.S. Cl. ..... 345/87; 345/103; 345/698
(58) Field of Search ..... 345/87, 698, 8, 345/212, 173, 76, 1.3, 96, 103, 699, 1.1; 701/211

(56) References Cited

U.S. PATENT DOCUMENTS

| | | | | |
|---|---|---|---|---|
| 4,123,751 A | * | 10/1978 | Gladstone et al. | 345/76 |
| 4,499,459 A | * | 2/1985 | Sasaki et al. | 345/204 |
| 5,448,259 A | * | 9/1995 | Hidaka | 345/98 |
| 5,534,892 A | * | 7/1996 | Tagawa | 345/173 |
| 5,568,163 A | * | 10/1996 | Okumura | 345/100 |
| 5,657,034 A | * | 8/1997 | Yamazaki | 345/8 |
| 5,754,160 A | * | 5/1998 | Shimizu et al. | 345/103 |
| 5,818,413 A | * | 10/1998 | Hayashi et al. | 345/100 |
| 6,124,853 A | * | 9/2000 | Palalau | 345/212 |
| 6,243,645 B1 | * | 6/2001 | Moteki et al. | 340/988 |
| 6,380,919 B1 | * | 4/2002 | Koyama et al. | 345/100 |

FOREIGN PATENT DOCUMENTS

| | | |
|---|---|---|
| JP | 5-64108 | 3/1993 |
| JP | 09-62230 | 3/1997 |
| JP | 10-62811 | 3/1998 |

* cited by examiner

*Primary Examiner*—Dennis-Doon Chow
(74) *Attorney, Agent, or Firm*—Foley & Lardner

(57) ABSTRACT

An LCD device is provided, which makes it possible to simultaneously display two images on a screen at unequal resolutions. This device is comprised of an LCD panel having pixels arranged in a matrix array and first and second display areas, where part of the pixels are located in the first display area and the remainder are located in the second display area. First and second horizontal drivers supply first and second data to the pixels arranged along the odd-numbered rows of the matrix in the first and second display areas, respectively. Third and fourth horizontal drivers supply third and fourth data to the pixels arranged along the even-numbered rows of the matrix in the first and second display areas, respectively. A first vertical driver selects the pixels arranged along the odd-numbered rows in the first and second display areas. A second vertical driver selects the pixels arranged along the even-numbered rows in the first and second display areas. The first and third horizontal drivers simultaneously supply the first and third data to the pixels arranged along one of the odd-numbered rows of the matrix in the first display area and those arranged along an adjoining one of the even-numbered rows of the matrix to the supplied row in the first display area, respectively.

12 Claims, 7 Drawing Sheets

LCD DEVICE AND DRIVING METHOD THEREOF

BACKGROUND OF THE INVENTION

1. Field of the Invention

The present invention relates to a Liquid-Crystal Display (LCD) device and more particularly, to an LCD device of the active-matrix addressing type that are capable of simultaneously displaying a television (TV) image and a car navigation image on the same screen at unequal resolutions, and a driving method of the device.

2. Description of the Prior Art

In general, on-vehicle LCD devices are used for displaying a car navigation image or a TV image. The vertical resolution of the on-vehicle LCD devices is typically set as approximately 240 scanning lines, which is optimum for displaying TV images.

FIG. 1 schematically shows the configuration of a prior-art LCD module as an example of LCD devices of this sort.

The prior-art LCD module of FIG. 1 comprises an LCD panel 310, two horizontal drivers 301 and 302 serving as data drivers, and a vertical driver 305 serving as a scanning driver.

The LCD panel 310 has scanning lines 311 extending along the rows of a matrix and arranged along the columns thereof at equal intervals, and data lines 312 extending along the columns of the matrix and arranged along the rows thereof at equal intervals. The panel 310 further has display elements (not shown) located at the respective intersections P of the scanning and data lines 311 and 312. The display elements constitute the respective pixels of the LCD device and therefore, these pixels are arranged in the matrix array. Each of the pixels arranged along any one of the data lines 312 corresponds to each of the rows of the matrix. Each of the pixels corresponding to the rows of the matrix is selected by scanning signals supplied through the scanning lines 311 and are driven by data signals supplied through the data lines 312.

The horizontal driver 301 receives a horizontal start signal HST, a horizontally-shifting clock signal HCK, and a video data signal VD. The driver 301 drives the pixels located on the left-hand side with respect to the panel 310 in FIG. 1.

The horizontal driver 302 receives the video data signal VD. Also, the driver 302 receives a horizontal start signal HST' and a horizontally-shifting clock signal HCK' supplied from the driver 301. The signal HST' has a specific temporal delay with respect to the horizontal start signal HST. Similarly, the signal HCK' has a specific temporal delay with respect to the horizontally-shifting clock signal HCK. The driver 302 drives the pixels located on the right-hand side with respect to the panel 310 in FIG. 1.

The vertical driver 305 receives a vertical start signal VST and a vertically-shifting clock signal VCK.

The panel 310 is driven by the horizontal drivers 301 and 302, which is due to the fact that the total number of the data lines 312 is greater than the output terminals of each of the drivers 301 and 302.

In recent years, there has been a tendency that the amount of information contained in the navigation images increases according to the ongoing functional expansion of car navigation systems. Under such tendency, there has been the growing need to enlarge the screen size and to raise the resolution in the on-vehicle LCD devices. Furthermore, there has been the need to make it possible to display different images on the two horizontally-divided display areas of the screen, which is termed the "dual-image displaying function".

It is comparatively easy to display two different images on the horizontally-divided display areas of the screen at an equal vertical resolution. For example, it can be realized by applying different video data VD to the horizontal drivers 301 and 302 in the module of FIG. 1.

However, it is not easy to display two different images on the horizontally-divided display areas of the screen at unequal vertical resolutions. For example, it is not easy to display a high-resolution navigation image and a normal-resolution TV image on the divided display areas. This is because the displayable resolution is determined by a lower one of the resolutions. As a result, there arises a problem that the resolution of the navigation image is degraded.

On the other hand, to realize high-quality images, there has been known a technique that an interlace signal is converted to a non-interlace signal by double-scanning conversion and then, the non-interlace signal thus produced is used for displaying high-quality images. This is termed the "double-scanning technique". If this technique is used, the vertical resolution can be improved.

A prior-art LCD device of this sort is disclosed in the Japanese Non-Examined Patent Publication No. 5-64108 published in December 1993. The LCD panel of this prior-art device is comprised of an odd-numbered row data driver for driving the pixels in the odd-numbered rows of the matrix, an odd-numbered row scanning driver for scanning the same pixels, an even-numbered row data driver for driving the pixels in the even-numbered rows of the matrix, and an odd-numbered row scanning driver for scanning the same pixels. These four drivers are operable independently. Each of the odd- and even-numbered row data drivers receives alternately an actual signal generated by a double-scanning converter circuit and an interpolating signal at each vertical scanning period (1V). Each of the odd- and even-numbered row scanning drivers drives simultaneously the pixels in the odd-numbered or even-numbered rows.

Thus, the prior-art LCD device disclosed in the Publication No. 5-64108 provides high-quality TV images without raising the operating frequency of the data and scanning drivers.

Another prior-art LCD device of this sort is disclosed in the Japanese Non-Examined Patent Publication No. 10-62811 published in March 1998. The LCD panel of this device is comprised of a first plurality of scanning lines and a second plurality of scanning lines, and a first plurality of data lines and a second plurality of data lines. The first plurality of scanning lines are driven by a scanning driver and the second plurality of scanning lines are driven by another scanning driver. The first plurality of data lines are connected to the pixels in the odd-numbered rows of a matrix. The second plurality of data lines are connected to the pixels in the even-numbered rows of the same matrix. The first plurality of scanning lines receive writing or resetting pulses. The second plurality of scanning lines receive writing or resetting pulses. The first and second pluralities of scanning lines are simultaneously driven by their corresponding scanning drivers. The pixels in the odd-numbered rows receive one of the writing and resetting pulses and at the same time, those in the even-numbered rows of the same matrix receive the other.

Thus, the prior-art LCD device disclosed in the Publication No. 10-62811 improves the contrast while the driving voltage is kept low, thereby providing high-quality images.

However, the prior-art LCD devices disclosed in the Publication Nos. 5-64108 and 10-62811 were developed in order to improve the quality of image displayed as a single image on the screen. As a result, similar to the prior-art LCD module shown in FIG. 1, it is difficult for these prior-art LCD devices to display two different images on the horizontally-divided display areas of the screen at unequal vertical resolutions.

SUMMARY OF THE INVENTION

Accordingly, an object of the present invention is to provide an LCD device and its driving method that make it possible to simultaneously display two images on a screen at unequal resolutions.

Another object of the present invention is to provide an LCD device and its driving method that make it possible to simultaneously display a high-resolution car navigation image and a normal-resolution TV image on a screen.

The above objects together with others not specifically mentioned will become clear to those skilled in the art from the following description.

According to a first aspect of the present invention, an LCD device is provided, which is comprised of:

(a) an LCD panel having pixels arranged in a matrix array with rows and columns;
  the panel having a first display area and a second display area;
  part of the pixels being located in the first display area and the remainder of the pixels being located in the second display area;

(b) a first horizontal driver for supplying a first data to the pixels arranged along the odd-numbered rows of the matrix in the first display area;

(c) a second horizontal driver for supplying a second data to the pixels arranged along the odd-numbered rows of the matrix in the second display area;

(d) a third horizontal driver for supplying a third data to the pixels arranged along the even-numbered rows of the matrix in the first display area;

(e) a fourth horizontal driver for supplying a fourth data to the pixels arranged along the even-numbered rows of the matrix in the second display area;

(f) a first vertical driver for selecting the pixels arranged along the odd-numbered rows of the matrix in the first and second display areas; and (g) a second vertical driver for selecting the pixels arranged along the even-numbered rows of the matrix in the first and second display areas.

The first and third horizontal drivers simultaneously supply the first and third data to the pixels arranged along one of the odd-numbered rows of the matrix in the first display area and those arranged along an adjoining one of the even-numbered rows of the matrix to the supplied row in the first display area, respectively.

With the LCD device according to the first aspect of the present invention, the first and second horizontal drivers are provided to supply the first and second data to the pixels arranged along the odd-numbered rows of the matrix in the first and second display areas of the LCD panel, and the third and fourth horizontal drivers are provided to supply the third and fourth data to the pixels arranged along the even-numbered rows of the matrix in the first and second display areas of the panel. The first vertical driver is provided to select the pixels arranged along the odd-numbered rows in the first and second display areas. The second vertical driver is provided to select the pixels arranged along the even-numbered rows in the first and second display areas.

Moreover, the first and third horizontal drivers simultaneously supply the first and third data to the pixels arranged along one of the odd-numbered rows in the first display area and those arranged along an adjoining one of the even-numbered rows to the row supplied with the first data in the first display area, respectively.

Thus, when the first and third data have the same content, an image is displayed at a relatively low resolution in the first display area. When the first and third data have different contents, an image is displayed at a relatively high resolution in the first display area. As a result, two images with different resolutions can be simultaneously displayed in the first and second display areas. This means that two images can be displayed on the screen at unequal resolutions.

If one of the two images is car navigation image and the other is TV image, a high-resolution car navigation image and a normal-resolution TV image can be displayed simultaneously on the screen.

In a preferred embodiment of the device according to the first aspect of the invention, the first vertical driver selects the pixels arranged along one of the odd-numbered rows in the first display area and at the same time, the second vertical driver selects the pixels arranged along an adjoining one of the even-numbered rows to the row selected by the first vertical driver in the first display area.

In another preferred embodiment of the device according to the first aspect of the invention, the first and third horizontal drivers are formed on a first horizontal driver IC and the second and fourth horizontal drivers are formed on a second horizontal driver IC. In this embodiment, there is an additional advantage that electrical wiring or interconnection on the panel is facilitated, and that the fabrication cost of the LCD device itself is lowered.

According to a second aspect of the present invention, a driving method of an LCD device is provided, which is comprised of the steps of:

(a) preparing an LCD panel having pixels arranged in a matrix array with rows and columns;
  the panel having a first display area and a second display area;
  part of the pixels being located in the first display area and the remainder of the pixels being located in the second display area;

(b) supplying a first data to the pixels arranged along the odd-numbered rows of the matrix in the first display area;

(c) supplying a second data to the pixels arranged along the odd-numbered rows of the matrix in the second display area;

(d) supplying a third data to the pixels arranged along the even-numbered rows of the matrix in the first display area;

(e) supplying a fourth data to the pixels arranged along the even-numbered rows of the matrix in the second display area;

(f) selecting the pixels arranged along the odd-numbered rows of the matrix in the first and second display areas; and (g) selecting the pixels arranged along the even-numbered rows of the matrix in the first and second display areas.

The first and third data are simultaneously supplied to the pixels arranged along one of the odd-numbered rows of the matrix in the first display area and to those arranged along an adjoining one of the even-numbered rows of the matrix to the supplied row in the first display area, respectively.

With the driving method of an LCD device according to the second aspect of the present invention, because of substantially the same reason as described about the LCD device according to the first aspect, two images with different resolutions can be simultaneously displayed in the first and second display areas. This means that two images can be displayed on the screen at unequal resolutions. If one of the two images is car navigation image and the other is TV image, a high-resolution car navigation image and a normal-resolution TV image can be displayed simultaneously on the screen.

In a preferred embodiment of the method according to the second aspect of the invention, the pixels arranged along one of the odd-numbered rows in the first display area are selected and at the same time, the pixels arranged along an adjoining one of the even-numbered rows to the row selected in the first display area are selected.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
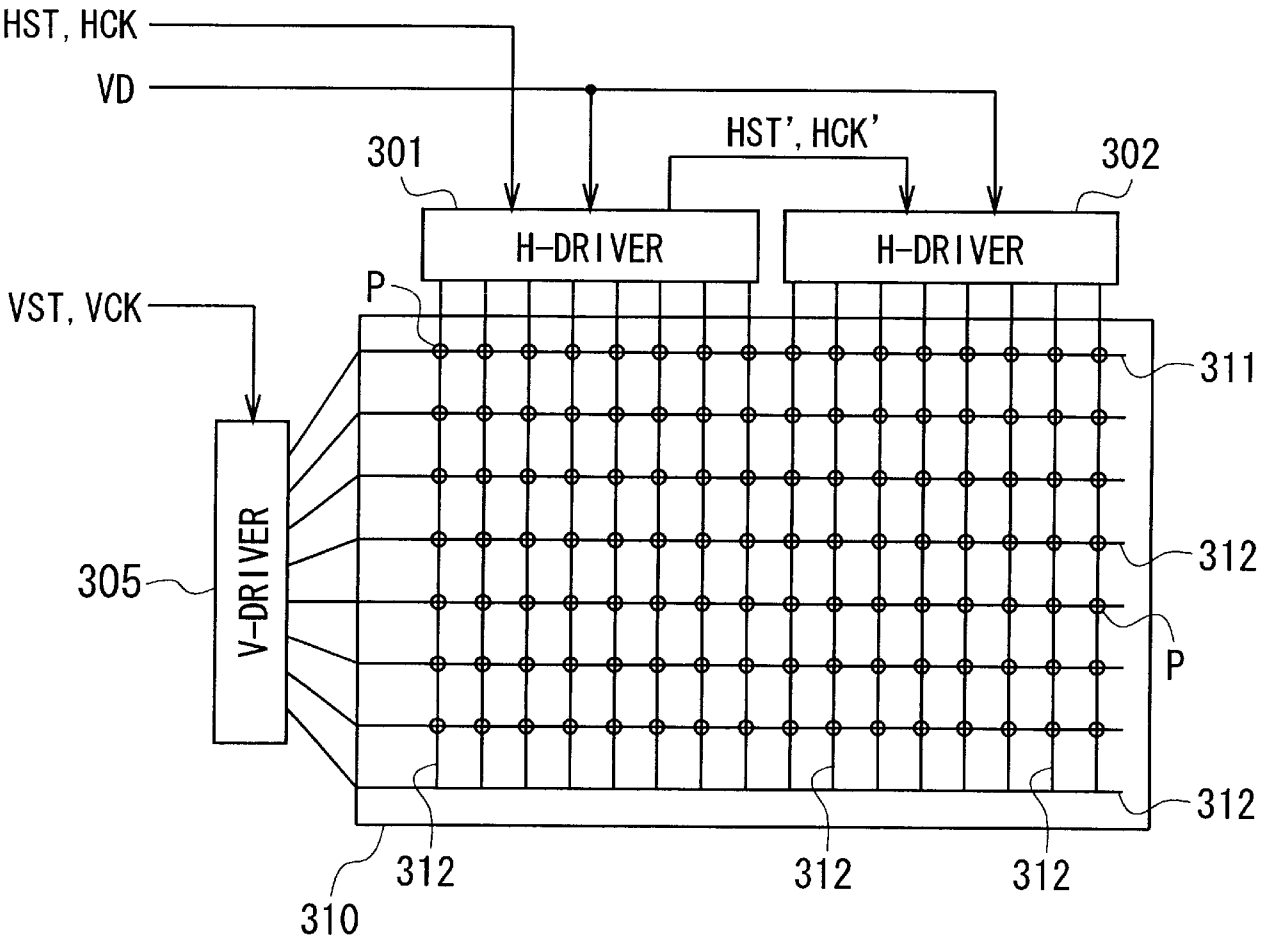
FIG. 1 PRIOR ART
FIG. 1 is a schematic view showing the configuration of a prior-art LCD module.

Preferred embodiments of the present invention will be described in detail below while referring to the drawings attached.

First Embodiment

Figure 2:
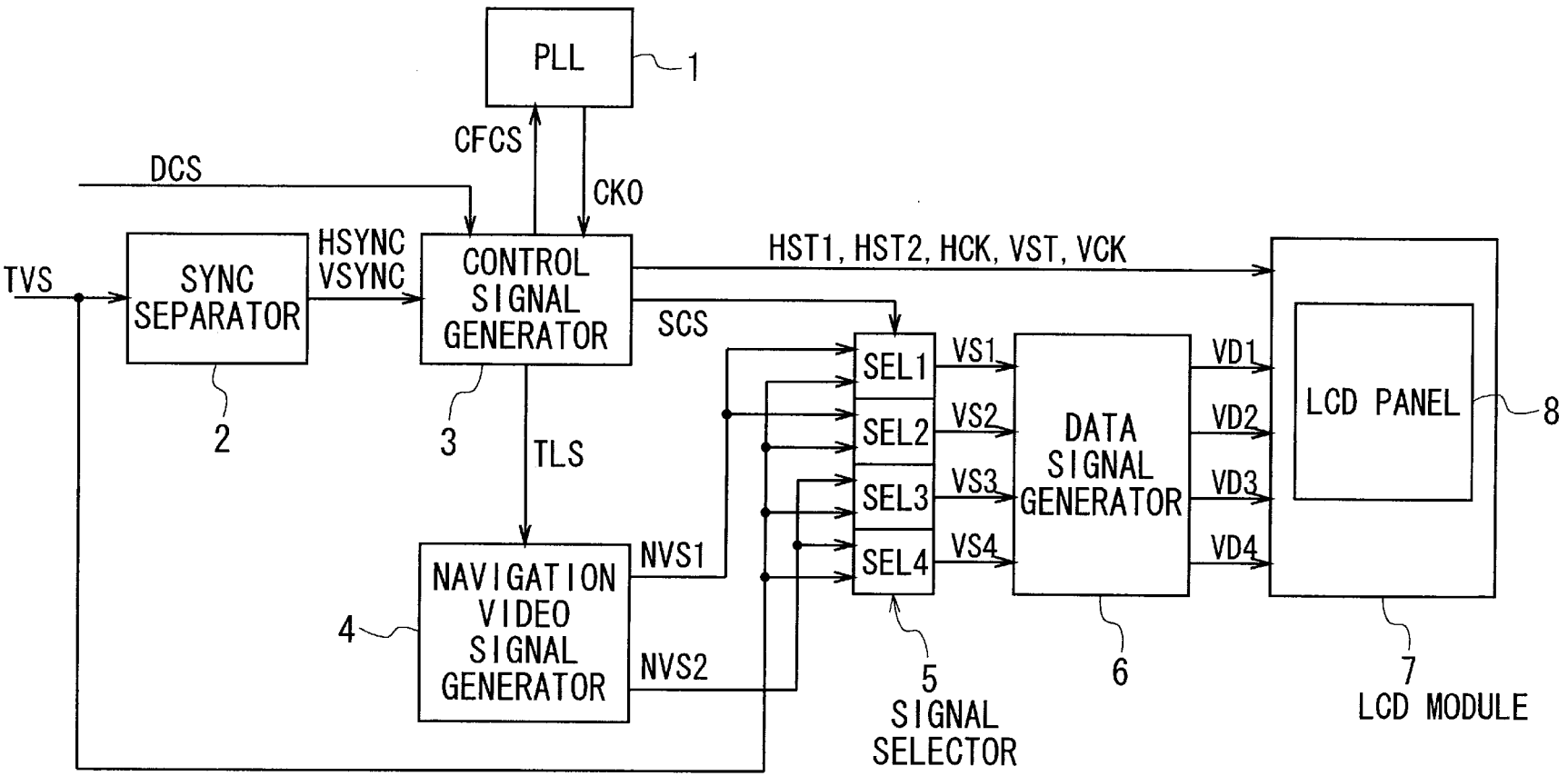
FIG. 2 is a schematic view showing the configuration of an LCD device according to a first embodiment of the present invention.

An LCD device according to a first embodiment has a configuration as shown in FIG. 2.

As seen from FIG. 2, the LCD device is comprised of a Phase-Locked Loop (PLL) circuit 1, a sync separator 2, a control signal generator 3, a navigation video signal generator 4, a signal selector 5, a data signal generator 6, and an LCD module 7. The reference numeral 8 denotes an LCD panel incorporated into the module 7.

The PLL circuit 1 generates a reference clock signal CK0 synchronized with a TV signal TVS and sends the signal CK0 thus generated to the control signal generator 3.

The sync separator 2 separates a horizontal synchronization signal HSYNC and a vertical synchronization signal VSYNC from the TV signal TVS supplied from the outside of the LCD device. Then, the separator 2 sends the horizontal and vertical synchronization signals HSYNC and VSYNC thus separated to the control signal generator 3.

The control signal generator 3 generates a clock frequency control signal CFCS on the basis of the horizontal and vertical synchronization signals HSYNC and VSYNC sent from the sync separator 2, outputting the signal CFCS thus generated to the PLL circuit 1. Also, the generator 3 generates a first horizontal start signal HST1, a second horizontal start signal HST2, a horizontal clock signal HCK, a vertical start signal VST, and a vertical clock signal VCK on the basis of the reference clock signal CK0, outputting the signals HST1, HST2, HCK, VST, and VCK thus generated to the LCD module 7. Moreover, the generator 3 generates a TV-synchronization lock signal TLS for synchronizing a navigation signal with the TV signal TVS on the basis of the reference clock signal CK0, outputting the signals TLS thus generated to the navigation video signal generator 4. Furthermore, the generator 3 generates a selection control signal SCS on the basis of a display control signal DCS supplied from the outside of the LCD device, outputting the signal SCS thus generated to the signal selector 5.

The navigation video signal generator 4 generates two navigation video signals NVS1 and NVS2 synchronized with the TV signal TVS, outputting the signals NVS1 and NVS2 to the signal selector 5. The synchronization of the signals NVS1 and NVS2 with the TV signal TVS is realized by the TV-synchronization lock signal TLS sent from the control signal generator 3.

The signal selector 5 comprises four selection switches SEL1, SEL2, SEL3, and SEL4. Each of the switches SEL1 and SEL2 receives the TV signal TVS sent from the outside of the LCD device and the navigation video signal NVS1 sent from the navigation video signal generator 4. Each of the switches SEL3 and SEL4 receives the TV signal TVS and the navigation video signal NVS2 sent from the generator 4.

The selection switch SEL1 selects one of the TV and navigation video signals TVS and NVS1 and then, outputs the signal TVS or NVS1 thus selected to the data signal generator 6 as a first video signal VS1. The selection switch SEL2 selects one of the TV and navigation video signals TVS and NVS1 and then, outputs the signal TVS or NVS1 thus selected to the generator 6 as a second video signal VS1. The selection switch SEL3 selects one of the TV and navigation video signals TVS and NVS2 and then, outputs the signal TVS or NVS2 thus selected to the generator 6 as a third video signal VS3. The selection switch SEL4 selects one of the TV and navigation video signals TVS and NVS2 and then, outputs the signal TVS or NVS2 thus selected to the generator 6 as a fourth video signal VS4.

The data signal generator 6 receives the first, second, third, and fourth video signals VS1, VS2, VS3, and VS4 and then, converts the signals VS1, VS2, VS3, and VS4 to first, second, third, and fourth video data signals VD1, VD2, VD3, and VD4, respectively. These fourth signals VD1, VD2, VD3, and VD4 have necessary voltage values for driving the LCD panel 8. This conversion is carried out in consideration of the gamma characteristics of liquid crystal used. The generator 6 outputs the video data signals VD1, VD2, VD3, and VD4 thus generated to the LCD module 7.

Figure 3:
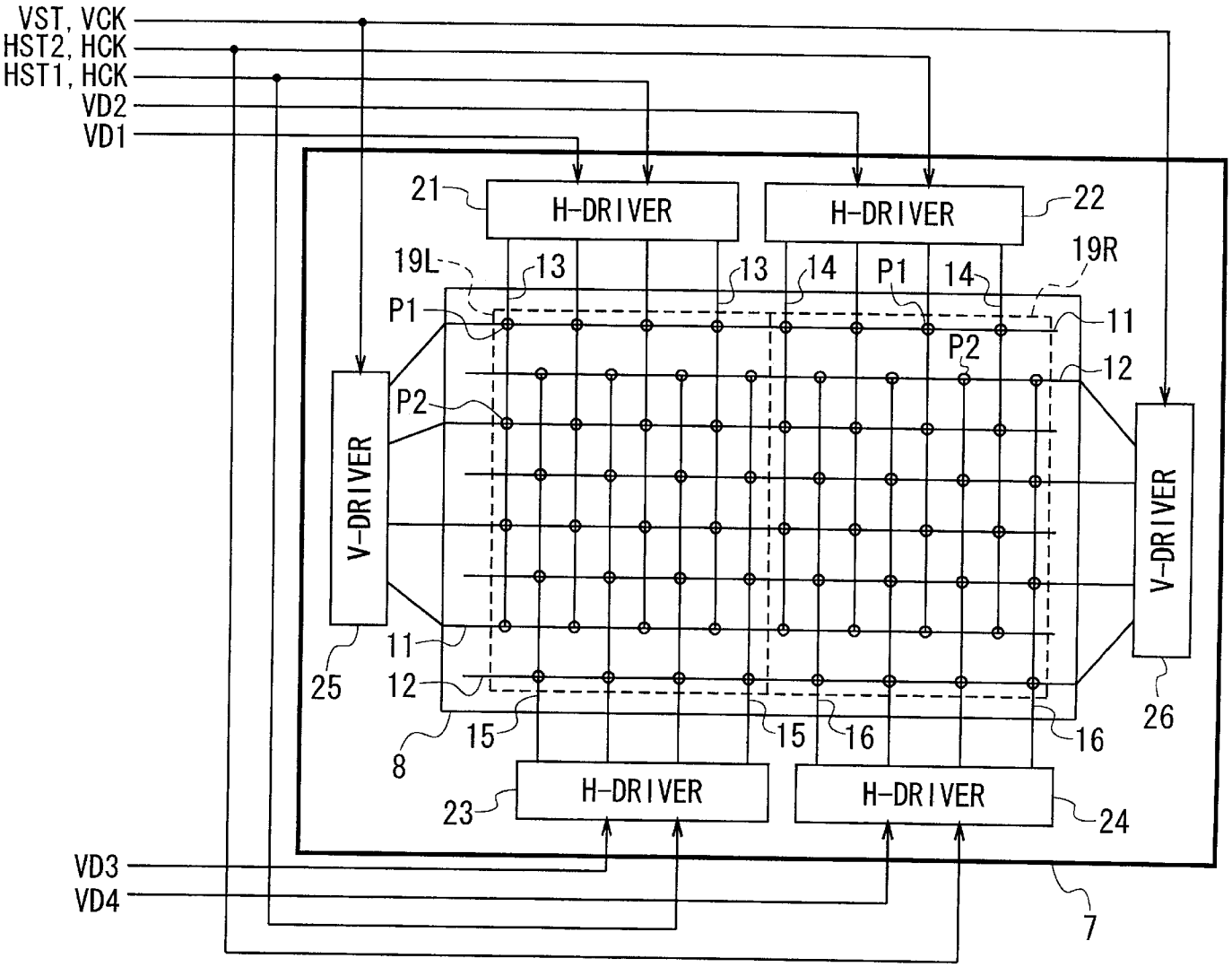
FIG. 3 is a schematic view showing the configuration of the LCD module used in the LCD device according to the first embodiment shown in FIG. 2.

As shown in FIG. 3, the LCD module 7 is comprised of the LCD panel 8, first, second, third, and fourth horizontal drivers 21, 22, 23, and 24 serving as data drivers, and first and second vertical drivers 25 and 26 serving as scanning drivers.

The panel 8 comprises a first set of scanning lines 11, a second set of scanning lines 12, a first set of data lines 13, a second set of data lines 15, a third set of data lines 14, a fourth set of data lines 16. The first and second sets of scanning lines 11 and 12 are formed to extend along the rows of a matrix and arranged alternately along the columns of the matrix at equal intervals. The first to fourth sets of data lines 13, 14, 15, and 16 are formed to extend along the columns of the matrix and arranged alternately along the rows of the matrix at equal intervals. The first and third sets of data lines 13 and 15 are located in the left-hand side display area 19L of the panel 7. The second and fourth sets of data lines 14 and 16 are located in the right-hand side display area 19R of the panel 7.

The panel 8 further comprises display elements (i.e., pixels, not shown in FIG. 3) located at the respective intersections P1 of the first set of scanning lines 11 with the first and second sets of data lines 13 and 14 and at the respective intersections P2 of the second set of scanning lines 12 with the third and fourth sets of data lines 15 and 16. Thus, the elements or pixels arranged along each of the first set of data lines 11 are located in a corresponding one of the odd-numbered rows of the matrix, and those arranged along each of the second set of data lines 12 are located in a corresponding one of the even-numbered rows of the matrix.

The pixels located in the odd-numbered rows are selected by the selection signal sent through the first set of scanning lines 11 and are driven by the data signals sent through the first and second sets of data lines 13 and 14. Similarly, the pixels located in the even-numbered rows are selected by the selection signal sent through the second set of scanning lines 12 and are driven by the data signals sent through the third and fourth sets of data lines 15 and 16.

The first set of scanning lines 11 are electrically connected to the first vertical driver 25. The second set of scanning lines 12 are electrically connected to the second vertical driver 26.

The first set of data lines 13 located in the left-hand side display area 19L are electrically connected to the first horizontal driver 21. The second set of data lines 14 located in the right-hand side display area 19R are electrically connected to the second horizontal driver 22. The third set of data lines 15 located in the left-hand side display area 19L are electrically connected to the third horizontal driver 23. The fourth set of data lines 16 located in the right-hand side display area 19R are electrically connected to the fourth horizontal driver 24.

The first horizontal driver 21 receives the first video data signal VD1, the first horizontal start signal HST1, and the horizontal clock signal HCK. The driver 21 drives the pixels located in the odd-numbered rows in the display area 19L.

The second horizontal driver 22 receives the second video data signal VD2, the second horizontal start signal HST2, and the horizontal clock signal HCK. The driver 22 drives the pixels located in the odd-numbered rows in the display area 19R.

The third horizontal driver 23 receives the third video data signal VD3, the first horizontal start signal HST1, and the horizontal clock signal HCK. The driver 23 drives the pixels located in the even-numbered rows in the display area 19L.

The fourth horizontal driver 24 receives the fourth video data signal VD4, the second horizontal start signal HST2, and the horizontal clock signal HCK. The driver 24 drives the pixels located in the even-numbered rows in the display area 19R.

Each of the first and second vertical drivers 25 and 26 receives the vertical start signal VST and the vertical clock signal VCK. The first and second vertical drivers 25 and 26 select the pixels to be driven.

Next, the operation of the LCD device according to the first embodiment shown in FIGS. 2 and 3 is explained below with reference to FIGS. 4A and 4B.

First, the operation to display a high-resolution car navigation image and a normal-resolution TV image on a screen is described.

Figure 4A:
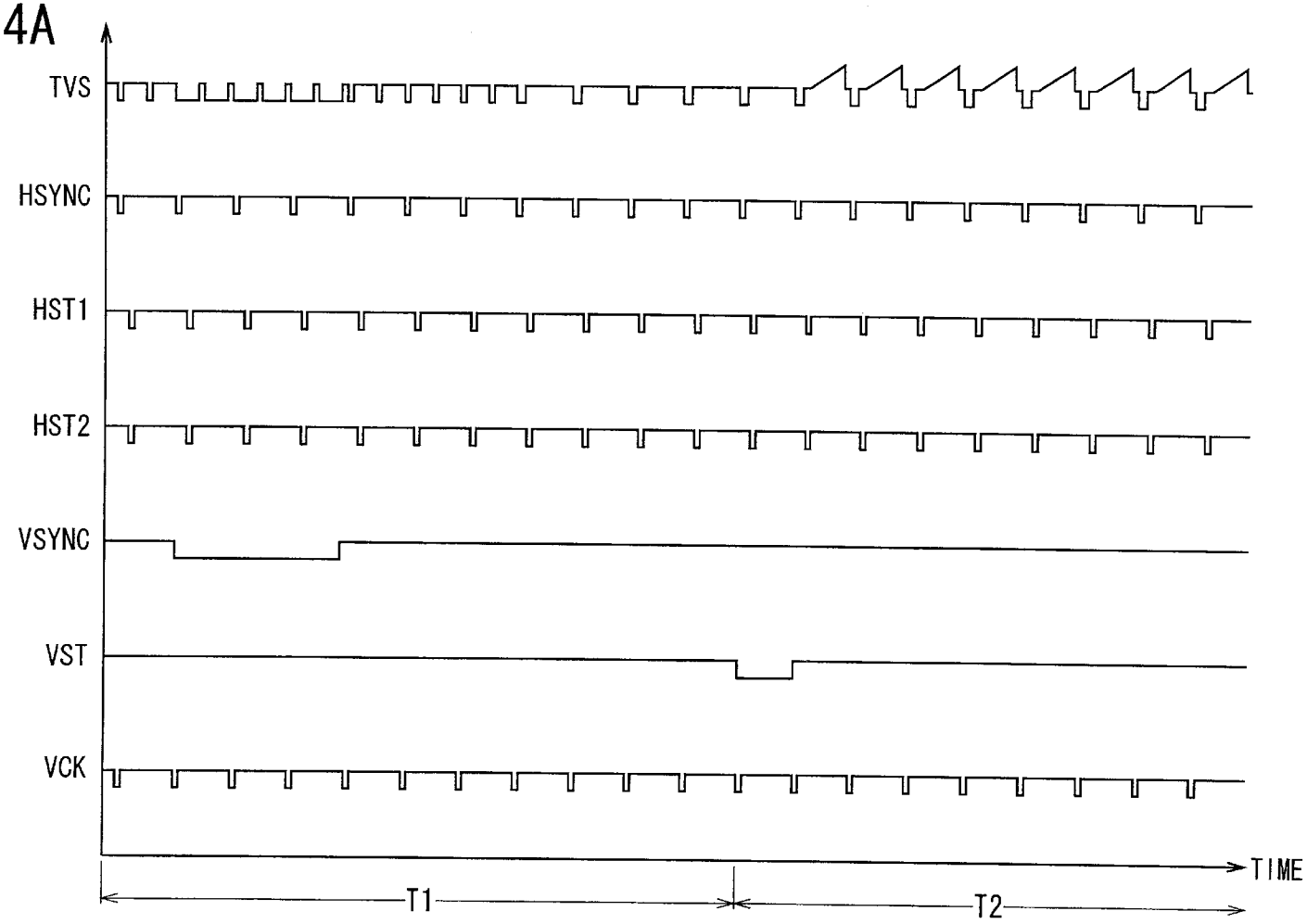
FIGS. 4A and 4B are timing diagrams showing the operation of the LCD device according to the first embodiment shown in FIG. 2.
Figure 4B:
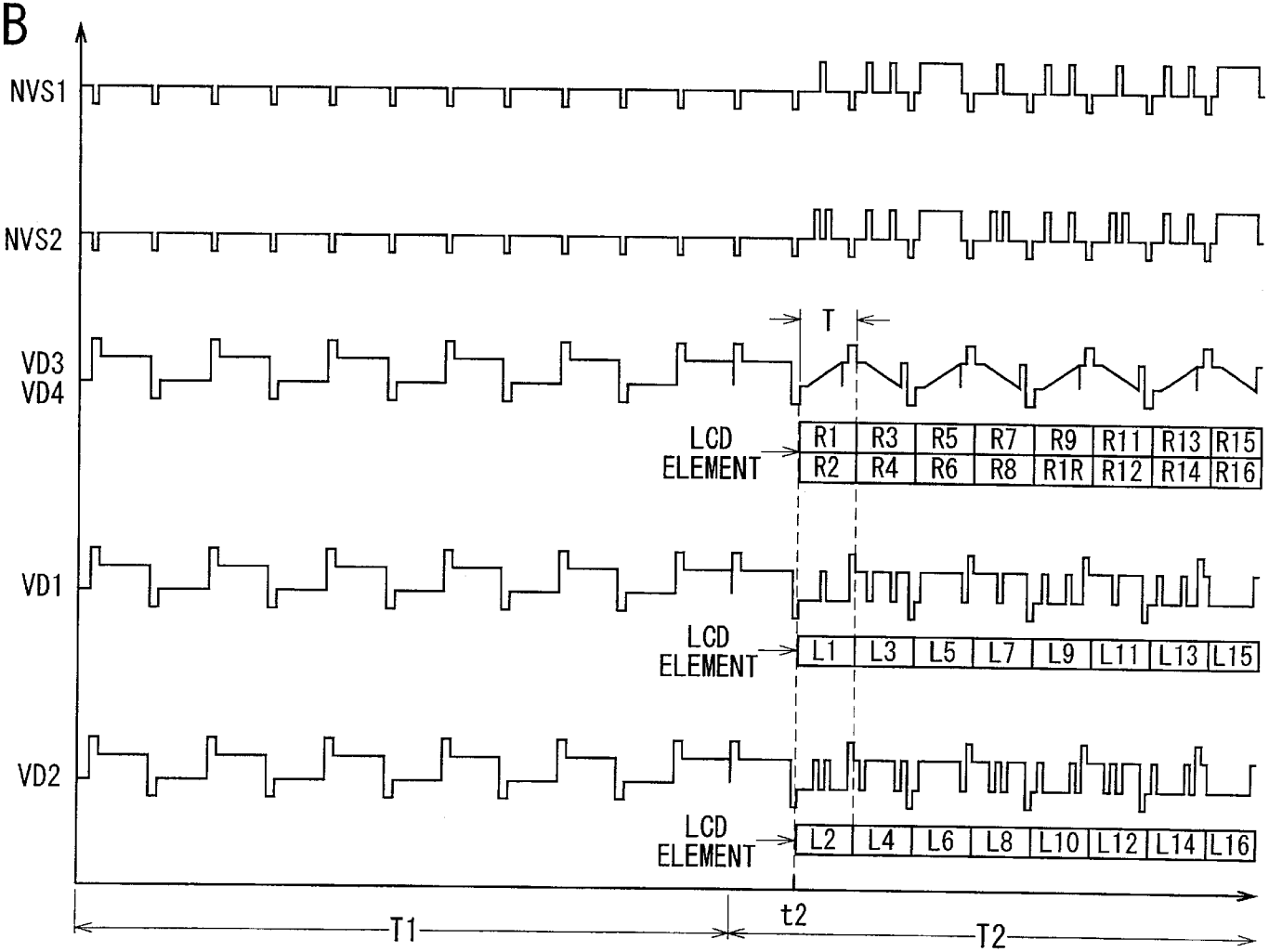

As shown in FIGS. 4A and 4B, in the period T1, the LCD device operates in a standby mode for operation stabilization. In the standby period T1, the sync separator 2 outputs the horizontal synchronization signal HSYNC and the vertical synchronization signal VSYNC to the control signal generator 3. The PLL circuit 1 outputs the reference clock signal VCK0 to the generator 3. The generator 3 outputs the first and second horizontal start signals HST1 and HST2, the horizontal clock signal HCK, the vertical start signal VST, and vertical clock signal VCK to the LCD module 7. Also, the generator 3 outputs the TV-synchronization lock signal TLS to the navigation video signal generator 4. At this time, the generator 3 does not output the selection control signal SCS to the signal selector 5.

The output of the reference clock signal VCK0 from the PLL circuit 1, that of the horizontal and vertical synchronization signals HSYNC and VSYNC from the synch separator 2, and that of the first and second horizontal start signals HST1 and HST2, the horizontal clock signal HCK, the vertical start signal VST, and the vertical clock signal VCK from the control signal generator 3 are carried out in any period other than the standby period T1, also.

The navigation video signal generator 4 generates the two navigation video signals NVS1 and NVS2 that contain no video components, thereby outputting the signals NVS1 and NVS2 to the signal selector 5, as shown in FIG. 4B.

When the selection control signal SCS is not supplied, the selection switches SEL1 and SEL2 of the signal selector 5 select the navigation video signal NVS1, outputting the signal NVS1 thus selected to the data signal generator 6 as the first and second video signals VS1 and VS2. Similarly, in this case, the selection switches SEL3 and SEL4 of the signal selector 5 select the navigation video signal NVS2, outputting the signal NVS2 thus selected to the data signal generator 6 as the third and fourth video signals VS3 and VS4.

In response to the first to fourth video signals VS1, VS2, VS3, and VS4, the data signal generator 6 outputs the first, second, third, and fourth video data signals VD1, VD2, VD3, and VD4 that contain no video components to the LCD module 7, as shown in FIG. 4B. Thus, no image is displayed on the screen of the module 7 in the standby period T1.

As shown in FIG. 4B, the waveforms of the video data signals VD1, VD2, VD3, and VD4 include polarity-inverted pulses at each scanning period T.

After the standby period T1 is completed, when the display control signal DCS instructs the control signal generator 3 to operate in the "dual image mode", the dual image period T2 is started, as shown in FIGS. 4A and 4B.

As explained above, in the dual image period T2 also, the output of the reference clock signal VCK0 from the PLL circuit 1, that of the horizontal and vertical synchronization signals HSYNC and VSYNC from the synch separator 2, and that of the first and second horizontal start signals HST1 and HST2, the horizontal clock signal HCK, the vertical start signal VST, and vertical clock signal VCK from the control signal generator 3 are carried out, which is the same as that in the standby period T1.

According to the instruction of the display control signal DCS, the control signal generator 3 outputs the TV-synchronization lock signal TLS to the navigation video signal generator 4 and at the same time, outputs the selection control signal SCS corresponding to the dual image mode to the signal selector 5.

The navigation video signal generator 4, which has been supplied with the TV-synchronization lock signal TLS, generates the two navigation video signals NVS1 and NVS2 containing the navigation video components and outputs the signals NVS1 and NVS2 to the signal selector 5.

According to the instruction of the display control signal DCS, the selection switches SEL1 and SEL3 of the signal selector 5 select respectively the navigation video signals NVS1 and NVS2 and output them as the first and third video signals VS1 and VS3 to the LCD module 7, respectively. The selection switches SEL2 and SEL4 of the selector 5 select respectively the TV video signal TVS output it as the second and fourth video signals VS2 and VS4, respectively, according to the instruction of the signal DCS.

Then, the data signal generator 6 outputs the first and third video data signals VD1 and VD3 corresponding to the navigation video signals NVS1 and NVS2 and the second and fourth video data signals VD2 and VD4 corresponding to the TV video signals TVS. As shown in FIG. 4B, the waveforms of the signals VD1, VD2, VD3, and VD4 include polarity-inverted pulses at each scanning period T1, which is the same as that in the standby period T1.

Next, the operation of the LCD module 7 supplied with the first to fourth video data signals VD1, VD2, VD3, and VD4 is explained below with reference to FIGS. 4B and 5. Here, for the sake of simplification of explanation, the total number of the rows of the matrix of the panel 8 is supposed to 16.

Figure 5:
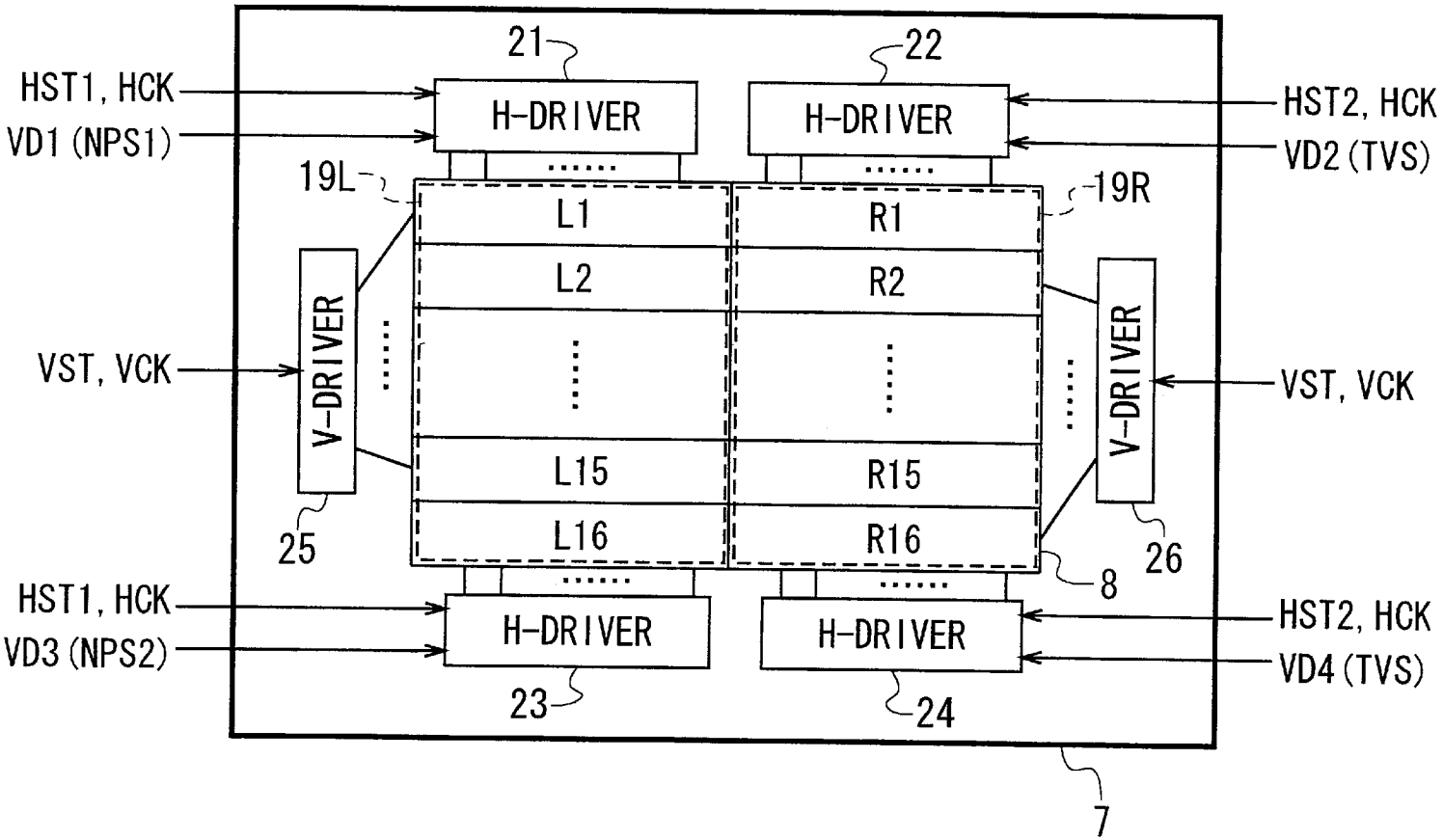
FIG. 5 is a schematic view showing the operation of the LCD device according to the first embodiment shown in FIG. 2.

As shown in FIG. 5, the first horizontal driver 21 is supplied with the first video data signal VD1 corresponding to the navigation video signal NVS1 and the third horizontal driver 23 is supplied with the second video data signal VD2 corresponding to the navigation video signal NVS1. Thus, the pixels arranged along the odd-numbered rows L1, L3, L5, . . . , L15 in the left-hand side display area 19L of the panel 8 are driven by the first video signal VD1 and at the same time, the pixels arranged along the even-numbered rows L2, L4, L6, . . . , L16 in the display area 19L are driven by the second video signal VD2. As a result, the desired navigation image is displayed in the left-hand side display area 19L.

At this time, as shown in FIG. 4B, the pixels arranged along the first row L1 and those along the second row L2 in the display area 19L are synchronously selected, which are respectively driven by the first and third video data signals VD1 and VD3 that contain different components or contents. Similarly, the pixels arranged along the third row L3 and those along the fourth row L4 in the display area 19L are synchronously selected, which are respectively driven by the first and third video data signals VD1 and VD3 that contain different components or contents. Thus, the pixels arranged along all the odd-numbered rows L1, L3, L5, . . . , L15 and those arranged along all the even-numbered rows L2, L4, L6, . . . , L16 in the area 19L are driven by the first and third video data signals VD1 and VD3, respectively. As a result, the desired navigation image is displayed in the display area 19L of the panel 8 at a specific vertical resolution, in other words, the high-resolution navigation image is displayed in the left area 19L.

On the other hand, the second and fourth horizontal drivers 22 and 24 are respectively supplied with the second and fourth video data signals VD2 and VD4, where the signals VD2 and VD4 correspond to the TV video signal TVS. Thus, the pixels arranged along all the odd-numbered rows R1, R3, R5, . . . , R15 in the right-hand side display area 19R of the panel 8 are driven by the second video signal VD2 and at the same time, the pixels arranged along all the even-numbered rows R2, R4, R6, . . . , R16 in the display area 19R are driven by the fourth video signal VD4. As a result, the desired TV image is displayed in the right display area 19R.

At this time, as shown in FIG. 4B, the pixels arranged along the first row R1 in the right display area 19R are synchronously selected which are respectively driven by the second and fourth video data signals VD2 and VD4 that contain the same component or content. Similarly, the pixels arranged along the third row R3 and those along the fourth row R4 in the display area 19R are synchronously selected, which are respectively driven by the second and fourth video data signals VD2 and VD4 that contain the same component or content. Thus, the pixels arranged along all the odd-numbered rows R1, R3, R5, . . . , R15 and those arranged along all the even-numbered rows R2, R4, R6, . . ., R16 in the area 19R are driven by the second and fourth video data signals VD2 and VD4, respectively. As a result, the desired TV image is displayed in the display area 19R of the panel 8 at a specific vertical resolution, in other words, the normal-resolution TV image is displayed in the right area 19R.

Furthermore, when only the high-resolution navigation image is displayed on the screen of the panel 8 in the "single image mode" for navigation images (i.e., the "navigation image mode"), the LCD device according to the first embodiment performs the following operation. For simplification, only the different points from that of the "dual image mode" is described here.

After the standby period T1 is completed, when the display control signal DCS instructs the control signal generator 3 to operate in the "navigation image mode", the control signal generator 3 outputs the selection control signal SCS corresponding to the "navigation image mode" to the signal selector 5. According to the instructions of the signal DCS, the selection switches SEL1 and SEL2 of the selector 5 select the navigation video signal NVS1 and then, output it as the first and second video signals VS1 and VS2 to the data signal generator 6, respectively. Similarly, according to the instructions of the signal DCS, the selection switches SEL3 and SEL4 of the selector 5 select the navigation video signal NVS2 and then, output it as the third and fourth video signals VS3 and VS4 to the generator 6, respectively.

In response to the signals VS1 to VS4, the video data signal generator 6 outputs the first and second video data signals VD1 and VD2 corresponding to the navigation video signal NVS1 and the third and fourth video data signals VD3 and VD4 corresponding to the navigation video signal NVS2 to the module 7. At this stage, the sampling period T is set in such a way that the first and second video data signals VD1 and VD2 correspond to the front half of the scanning period T (i.e., the left-hand side display area 19L) and that the third and fourth video data signals VD3 and VD4 correspond to the rear half of the period T (i.e., the right-hand side display area 19R).

The LCD panel 8 is driven by the first, second, third, and fourth video data signals VD1, VD2, VD3, and VD4 in the same way as that of the "dual image mode". Thus, the desired navigation image is displayed in the whole display area (i.e., in the display area 19L and 19R) of the panel 8.

In this case also, the first video signal VD1 for driving the pixels arranged along the odd-numbered rows L1, L3, L5, . . . , L15 in the left-hand side display area 19L is different in content or component from the third video signal VD3 for driving the cells arranged along the even-numbered rows L2, L4, L6, . . . , L16 in the same area 19L. Similarly, the second video signal VD2 for driving the pixels arranged along the odd-numbered rows R1, R3, R5, . . . , R15 in the right-hand side display area 19R is different in content or component from the fourth video signal VD4 for driving the pixels arranged along the even-numbered rows R2, R4, R6, . . . , R16 in the same display area 19R. As a result, the desired navigation image is displayed at the specific high resolution, i.e., the desired high-resolution navigation image is displayed on the whole screen of the panel 8.

Finally, when only the normal-resolution TV image is displayed on the screen of the panel 8 in the "single image mode" for TV images (i.e., the "TV image mode"), the LCD device according to the first embodiment performs the following operation. For simplification, only the different points from that of the "navigation image mode" is described here.

After the standby period T1 is completed, when the display control signal DCS instructs the control signal generator 3 to operate in the "TV image mode", the control signal generator 3 outputs the selection control signal SCS corresponding to the "TV image mode" to the signal selector 5. According to the instructions of the signal DCS, the selection switches SEL1, SEL2, SEL3, and SEL4 of the selector 5 select the TV video signal TVS and then, output it as the first, second, third, and fourth video signals VS1, VS2, VS3, and VS4 to the data signal generator 6, respectively.

In response to the signals VS1, VS2, VS3, and VS4, the data signal generator 6 outputs the first to fourth video data signals VD1, VD2, VD3, and VD4 corresponding to the TV video signal TVS to the module 7. At this stage, the sampling period T is set in such a way that the first and second video data signals VD1 and VD2 correspond to the front half of the scanning period T (i.e., the left-hand side display area 19L) and that the third and fourth video data signals VD3 and VD4 correspond to the rear half of the period T (i.e., the right-hand side display area 19R).

The LCD panel 8 is driven by the first, second, third, and fourth video data signals VD1, VD2, VD3, and VD4 in the same way as that of the "navigation image mode". Thus, the desired TV image is displayed in display areas 19L and 19R (i.e., in the whole screen of the panel 8).

In this case also, the first video signal VD1 for driving the pixels arranged along the odd-numbered rows L1, L3, L5, . . . , L15 in the left display area 19L is the same in content or component as the third video signal VD3 for driving the pixels arranged along the even-numbered rows L2, L4, L6, . . . , L16 in the same display area 19L. Similarly, the second video signal VD2 for driving the pixels arranged along the odd-numbered rows R1, R3, R5, . . . , R15 in the right display area 19R is the same in content or component as the fourth video signal VD4 for driving the pixels arranged along the even-numbered rows R2, R4, R6, . . . , R16 in the same display area 19R. As a result, the desired TV image is displayed at the specific vertical resolution, i.e., at the normal-resolution.

As explained in detail above, with the LCD device according to the first embodiment of the present invention, the LC cells or pixels arranged along the odd-numbered rows of the matrix in the left-hand side display area 19L of the panel 8 are driven by the first horizontal driver 21, and those arranged along the even-numbered rows of the matrix in the same display area 19L are driven by the third horizontal driver 23. Also, the pixels arranged along the odd-numbered rows of the matrix in the right-hand side display area 19R of the panel 8 are driven by the second horizontal driver 22, and those arranged along the even-numbered rows of the matrix in the same display area 19R are driven by the fourth horizontal driver 24.

Moreover, the pixels arranged along the odd-numbered rows in the two display areas 19L and 19R are driven by the first vertical driver 25, and those arranged along the even-numbered rows in the areas 19L and 19R are driven by the second vertical driver 26. The pixels arranged along two adjoining ones of the odd- and even-numbered rows are driven synchronously.

Accordingly, when the first and third horizontal drivers 21 and 23 receive one of the video data signals containing the TV navigation images and at the same time, the second and fourth horizontal drivers 22 and 24 receive the other, both the TV and navigation images can be simultaneously displayed on the screen of the panel 8. This is realized without lowering the vertical resolution of the navigation image.

Furthermore, the pixels arranged in one of the odd-numbered and its adjoining one of the even-numbered rows are selected synchronously. Thus, when the pixels arranged in the odd-numbered rows and those arranged in the even-numbered rows are driven by the image data signals containing the same component, the desired TV image is displayed at the normal resolution. When the pixels arranged in the odd-numbered rows and those arranged in the even-numbered rows are driven by the image data signals containing different components, the desired navigation image is displayed at the high resolution.

As a result, the high-resolution navigation image can be displayed on the screen of the panel 8 while the normal-resolution TV image is displayed on the same screen.

Second Embodiment

Figure 6:
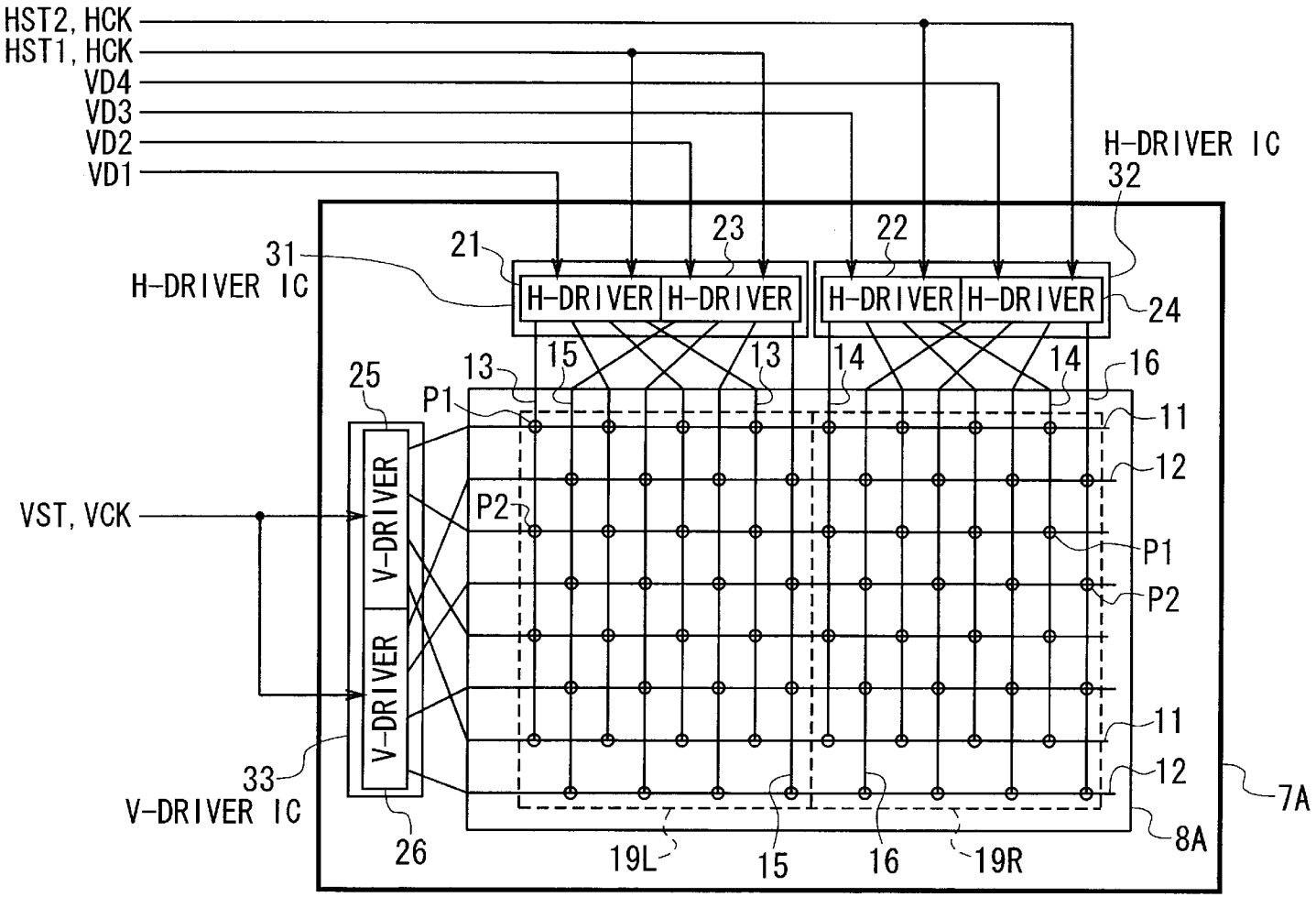
FIG. 6 is a schematic view showing the configuration of the LCD module used in an LCD device according to a second embodiment of the present invention.

FIG. 6 shows schematically the configuration of an LCD module 7A of an LCD device according to a second embodiment.

The module 7A in FIG. 6 has the same configuration as that of the module 7 of the LCD device according to the first embodiment of FIG. 3, except that the first to fourth horizontal drivers 21, 22, 23, and 24 are formed as a semiconductor Integrated circuit (IC) and that the first and second vertical drivers 25 and 26 are formed as another IC. Thus, the explanation about the same configuration is omitted here for the sake of simplification by attaching the same reference symbols as those used in the first embodiment of FIG. 3 to the same elements in FIG. 6.

In addition, the LCD device according to the second embodiment has the same configuration as that of the LCD device according to the first embodiment of FIG. 2, other than that the module 7 is replaced with the module 7A.

As seen from FIG. 6, the module 7A comprises a LCD panel 8A, first and second horizontal driver ICs 31 and 32, and a vertical driver IC 33.

The first horizontal driver IC 31 includes the first and third horizontal drivers 21 and 23 for driving the pixels arranged in the left-hand side display area 19L of the panel 8A. The second horizontal driver IC 32 includes the second and fourth horizontal drivers 22 and 24 for driving the pixels arranged in the right-hand side display area 19R of the panel 8A.

The vertical driver IC 33 includes the first vertical driver 25 for selecting the pixels arranged along the odd-numbered rows of the matrix and the second vertical driver 26 for selecting the pixels arranged along the even-numbered rows thereof.

Thus, with the LCD device according to the second embodiment, the pixels are driven by the three driver ICS 31, 32, and 33 and therefore, there is an additional advantage that the electrical wiring or interconnection on the panel 8A is facilitated, and that the fabrication cost of the module 7A and the LCD device itself is lowered.

Needless to say, the LCD device according to the second embodiment of FIG. 6 has the same advantages as those in the LCD device according to the first embodiment of FIGS. 2 and 3.

While the preferred forms of the present invention have been described, it is to be understood that modification will be apparent to those skilled in the art without departing from the spirit of the invention. The scope of the present invention, therefore, is to be determined solely by the following claims.

What is claimed is:

1. An LCD device comprising:

an LCD panel having a matrix of pixels providing a first display area and a second display area;

a first horizontal driver for supplying first data to pixels arranged along odd-numbered rows of said matrix in said first display area;

a second horizontal driver for supplying second data to pixels arranged along odd-numbered rows of said matrix in said second display area;

a third horizontal driver for supplying third data to pixels arranged along said even-numbered rows of said matrix in said first display area:

a fourth horizontal driver for supplying fourth data to pixels arranging along said even-numbered rows of said matrix in said second display area;

a first vertical driver for selecting pixels arranged along said odd-numbered rows of said matrix in the first and second display areas;

a second vertical driver for selecting pixels arranged along said even-numbered rows of said matrix in said first and second display areas; and a selector for selecting between low resolution display and high resolution display in at least one of said display areas;

wherein, when low resolution display is selected for a display area, the same data signals are supplied to respective pairs of odd and even rows of said display area to produce a low resolution display, and wherein, when high resolution display is selected for a display area, different data signals are supplied to each of said odd and even rows of said display area to produce a high resolution display.

2. The device according to claim 1, wherein said first and third horizontal drivers are formed on a first horizontal driver IC and said second and fourth horizontal drivers are formed on a second horizontal driver IC.

3. The device according to claim 1, wherein a car navigation image is displayed in said first display area and a TV image is displayed in said second display area.

4. A driving method of an LCD device, comprising:

providing an LCD panel having a matrix of pixels providing a first display area and a second display area;

selecting between low resolution display and high resolution display in at least one of said display areas;

supplying first data to pixels arranged along odd-numbered rows of said matrix in said first display area;

supplying second data to pixels arranged along odd-numbered rows of said matrix in said second display area;

supplying third data to pixels arranged along said even-numbered rows of said matrix in said first display area;

supplying fourth data to pixels arranged along said even-numbered rows of said matrix in said second display area;

selecting pixels arranged along said odd-numbered rows of said matrix in said first and second display areas while supplying said first and second data, and selecting pixels arranged along said even-numbered rows of said matrix in said first and second display areas while supplying said third and fourth data, wherein, when low resolution display is selected for a display area, the same data signals are supplied to respective pairs of odd and even rows of said display area to produce a low resolution display, and wherein, when high resolution display is selected for a display area, different data signals are supplied to each of said odd and even rows of said display area to produce a high resolution display.

5. The method according to claim 4, wherein a car navigation image is displayed in said first display area and a TV image is displayed in said second display area.

6. An LCD device comprising:

an LCD panel having a matrix of pixels providing a first display area and a second display area;

a first horizontal driver for supplying first data to pixels arranged along odd-numbered rows of said matrix in said first display area;

a second horizontal driver for supplying second data to pixels arranged along odd-numbered rows of said matrix in said second display area;

a third horizontal driver for supplying third data to pixels arranged along said even-numbered rows of said matrix in said first display area:

a fourth horizontal driver for supplying fourth data to pixels arranged along said even-numbered rows of said matrix in said second display area;

a first vertical driver for selecting pixels arranged along said odd-numbered rows of said matrix in the first and second display areas; and a second vertical driver for selecting pixels arranged along said even-numbered rows of said matrix in said first and second display areas;

a low resolution video signal source;

a high resolution video signal source;

a selector for selecting between display of said low resolution video signal and said high resolution video signal in at least one of said display areas; and a data signal generator for supplying data signals to said first, second, third and fourth horizontal drivers corresponding to video signals to be displayed in each of said display areas, wherein, when a low resolution video signal is selected for a display area, the data signal generator supplies the same data signals for respective pairs of odd and even rows of said display area to produce a low resolution display, and wherein, when a high resolution video signal is selected for a display area, the data signal generator supplies data signals independently for each of said odd and even rows of said display area to produce a high resolution display.

7. The LCD device claimed in claim 6, wherein said first and third horizontal drivers simultaneously supply said first and third data to pixels arranged along one of said odd-numbered rows of said matrix in said first display area and to pixels arranged along an adjoining one of said even-numbered rows of said matrix in said first display area, respectively.

8. The LCD device claimed in claim 6, wherein said first vertical driver selects said pixels arranged along one of said odd-numbered rows in said first display area and at the same time, said second vertical driver selects said pixels arranged along an adjoining one of said even-numbered rows.

9. The device according to claim 6, wherein said first and third horizontal drivers are formed on a first horizontal driver IC and said second and fourth horizontal drivers are formed on a second horizontal driver IC.

10. The device according to claim 6, wherein a high resolution car navigation image is displayed in said first display area and a low resolution television image is displayed in said second display area.

11. A method for driving an LCD device comprising first and second display areas, the method comprising:

supplying a low resolution video signal and a high resolution video signal selecting one of display of said low resolution video signal and display of said high resolution video signal for at least one of the first and second display areas; and supplying data signals to horizontal drivers of said LCD device corresponding to video signals selected for each of said display areas, wherein, when a low resolution video signal is selected for a display area, the same data signals are supplied to respective pairs of odd and even rows of said display area to produce a low resolution display, and wherein, when a high resolution video signal is selected for a display area, data signals are supplied independently to each of said odd and even rows of said display area to produce a high resolution display.

12. The method according to claim 11, wherein a high resolution car navigation image is displayed in said first display area and a low resolution television image is displayed in said second display area.

* * * * *